US008141549B2

(12) United States Patent
Armstrong et al.

(10) Patent No.: US 8,141,549 B2
(45) **Date of Patent: *Mar. 27, 2012**

(54) APPLIANCE WITH A VACUUM-BASED REVERSE AIRFLOW COOLING SYSTEM USING ONE FAN

(75) Inventors: James Armstrong, Louisville, KY (US); Philip Ames Barber, Louisville, KY (US); Jay Andrew Broniak, Louisville, KY (US); Steve B. Froelicher, Shepherdsville, KY (US); Kevin Scott Laundroche, Anchorage, KY (US); Michael Paul McGonagle, Louisville, KY (US); Derek Lee Watkins, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 667 days.

This patent is subject to a terminal disclaimer.

(21) Appl. No.: 12/209,545

(22) Filed: Sep. 12, 2008

(65) Prior Publication Data

US 2010/0065035 A1 Mar. 18, 2010

(51) Int. Cl.
*F24C 15/32* (2006.01)
*H05K 7/00* (2006.01)

(52) U.S. Cl. ..... 126/198; 126/273 R; 126/193; 126/287; 126/190; 219/394; 312/236

(58) Field of Classification Search ..... 126/21 A, 126/25 R, 273 A, 273 R, 190, 193, 198; 219/394; 312/236

See application file for complete search history.

(56) References Cited

U.S. PATENT DOCUMENTS

| | | | |
|---|---|---|---|
| 3,142,748 | A | 7/1964 | Warren |
| 3,409,003 | A | 11/1968 | Rehberg et al. |
| 3,509,868 | A | 5/1970 | Mono |
| 3,889,100 | A | 6/1975 | Dills |
| 4,180,049 | A | 12/1979 | Carr et al. |
| 4,354,084 | A | 10/1982 | Husslein et al. |

(Continued)

FOREIGN PATENT DOCUMENTS

JP 01139920 A * 1/1989

(Continued)

OTHER PUBLICATIONS

Office Action issued in connection with related U.S. Appl. No. 12/209,280, Mar. 4, 2011.

*Primary Examiner* — Steven B McAllister
*Assistant Examiner* — Nikhil Mashruwala
(74) *Attorney, Agent, or Firm* — Global Patent Operation; Douglas D. Zhang

(57) ABSTRACT

An appliance includes a housing having an airflow channel communicating with outside of the appliance; a first chamber in the housing and having a first opening; a first door for selectively closing the first opening, the first door having a first airway communicating with the outside of the appliance; a second chamber in the housing and having a second opening; a second door for selectively closing the second opening, the second door having a second airway communicating with the outside of the appliance; and a fan in the airflow channel. The airflow channel includes a central segment disposed between the first and second chambers and communicating with the first and second airways. When activated, the fan causes ambient air to pass through the first and second airways before entering the central segment so that the first and second doors are cooled off by the ambient air.

15 Claims, 2 Drawing Sheets

U.S. PATENT DOCUMENTS

| | | | | |
|---|---|---|---|---|
| 4,592,333 | A * | 6/1986 | Dustin | 126/21 R |
| 4,763,638 | A | 8/1988 | Hurley et al. | |
| 4,796,600 | A * | 1/1989 | Hurley et al. | 126/273 A |
| 5,193,520 | A * | 3/1993 | Gostelow et al. | 126/21 A |
| 5,215,073 | A | 6/1993 | Wilson | |
| 5,738,081 | A | 4/1998 | Puricelli | |
| 5,918,589 | A | 7/1999 | Valle et al. | |
| 6,300,609 | B1 | 10/2001 | Kim | |
| 6,344,637 | B2 | 2/2002 | Lee et al. | |
| 6,515,266 | B2 | 2/2003 | Nasu et al. | |
| 6,786,058 | B2 | 9/2004 | Sanna | |
| 6,913,012 | B2 * | 7/2005 | Divett et al. | 126/21 A |
| 6,967,310 | B2 | 11/2005 | Austin et al. | |
| 6,984,811 | B2 | 1/2006 | Lee | |
| 7,030,773 | B2 | 4/2006 | Peterson et al. | |
| 7,211,775 | B2 | 5/2007 | Lee | |
| 7,348,527 | B2 | 3/2008 | Braunisch et al. | |
| 7,650,881 | B2 * | 1/2010 | Brown et al. | 126/198 |
| 7,708,008 | B2 | 5/2010 | Elkasevic et al. | |
| 7,726,295 | B2 | 6/2010 | Elkasevic | |
| 7,762,250 | B2 * | 7/2010 | Elkasevic et al. | 126/198 |
| 2003/0131620 | A1 | 7/2003 | Sanna | |
| 2003/0168447 | A1 | 9/2003 | Lee | |
| 2004/0079355 | A1 | 4/2004 | Divett et al. | |
| 2005/0133019 | A1 | 6/2005 | Kim et al. | |
| 2005/0224490 | A1 | 10/2005 | Austin et al. | |
| 2006/0049191 | A1 | 3/2006 | Lee | |
| 2006/0137543 | A1 | 6/2006 | McLemore et al. | |
| 2006/0219234 | A1 * | 10/2006 | Larsen | 126/198 |
| 2006/0272632 | A1 | 12/2006 | Duncan et al. | |
| 2007/0102426 | A1 | 5/2007 | Braunisch et al. | |
| 2007/0210057 | A1 | 9/2007 | Stahl et al. | |
| 2008/0105140 | A1 | 5/2008 | Lee | |
| 2008/0184985 | A1 | 8/2008 | Hasselberger et al. | |
| 2008/0185372 | A1 | 8/2008 | Elkasevic | |
| 2008/0185373 | A1 | 8/2008 | Elkasevic et al. | |
| 2008/0185941 | A1 | 8/2008 | Geiger et al. | |
| 2008/0185942 | A1 | 8/2008 | Elkasevic et al. | |
| 2009/0032010 | A1 * | 2/2009 | Hoffmeier | 126/198 |
| 2009/0145031 | A1 | 6/2009 | Collene | |
| 2009/0183723 | A1 | 7/2009 | Hasselberger et al. | |
| 2010/0051244 | A1 * | 3/2010 | Armstrong et al. | 165/104.34 |
| 2010/0101556 | A1 | 4/2010 | Dell'Oglio et al. | |

FOREIGN PATENT DOCUMENTS

| | | | |
|---|---|---|---|
| WO | 03077601 | A1 | 9/2003 |
| WO | 2006021936 | A1 | 2/2006 |
| WO | 2007080037 | A1 | 7/2007 |
| WO | 2008032903 | A1 | 3/2008 |

* cited by examiner

APPLIANCE WITH A VACUUM-BASED REVERSE AIRFLOW COOLING SYSTEM USING ONE FAN

CROSS-REFERENCE TO RELATED APPLICATIONS

This application relates to the commonly owned application entitled "Appliance with a Vacuum-Based Reverse Airflow Cooling System", Ser. No. 12/209,280, filed concurrently.

BACKGROUND OF THE INVENTION

The present invention relates generally to an appliance. More particularly, the present invention relates to an appliance with a vacuum-based reverse airflow cooling system using one fan.

Dual-cavity ovens typically draw in ambient or cooling air via intakes located above the upper oven cavity and at the top of the oven where the controls are situated. Each oven cavity includes a fan for cooling the respective oven unit independently of the other oven unit. The fans may blow the air down the back of the oven units. The exhaust air for this type of system is usually evacuated at locations between the upper and lower oven units and also below the lower oven unit on the front side of the oven.

Typical duel-cavity oven designs limit where the oven control panel can be located, constraining it usually to a dedicated separate area over the oven door where an air intake is sometimes located. One disadvantage of the current dual-cavity oven design is that the control panel and fans use desirable space that could be used for oven capacity. Another disadvantage of the current dual-cavity oven design is that the oven doors prove too hot to serve as a suitable site for the control panel. The control panel can be damaged and malfunction because of the excessive heat of the oven door.

It would therefore be desirable to provide a cooling system for a dual-cavity oven or a dual-cavity oven providing the same wherein the cooling system uses just one fan for both cavities and enables the control panel to be mounted in or on the oven door. An advantage, in addition to enhanced cooling, is to increase usable space and volume for other purposes than housing the control panel, for example, to increase the size of oven capacity using the space that would have been consigned to the control panel.

BRIEF DESCRIPTION OF THE INVENTION

As described herein, the preferred embodiments of the present invention overcome one or more of the above or other disadvantages known in the art.

One aspect of the invention relates to an appliance. The appliance includes a housing having an airflow channel in flow communication with outside of the appliance; a first chamber disposed in the housing and having a first opening; a first door for selectively closing the first opening, the first door having a first airway in flow communication with the outside of the appliance; a second chamber disposed in the housing and having a second opening; a second door for selectively closing the second opening, the second door having a second airway in flow communication with the outside of the appliance; and a fan disposed in the airflow channel. The airflow channel includes a central segment disposed between the first and second chambers and in flow communication with the first and second airways. When activated, the fan causes ambient air from the outside of the appliance to pass through the first and second airways before entering the central segment so that the first and second doors are cooled off by the ambient air.

Another aspect of the invention relates to an appliance. The appliance includes a housing having an airflow channel in flow communication with outside of the appliance; a first oven chamber disposed in the housing and having a first frontal opening; a first door for selectively closing the first frontal opening, the first door having a first airway in flow communication with the outside of the appliance; a second oven chamber disposed in the housing and having a second frontal opening; a second door for selectively closing the second frontal opening, the second door having a second airway in flow communication with the outside of the appliance; a Human Machine Interface disposed on or in one of the first and second doors; and a fan disposed in the airflow channel. The airflow channel has a central segment disposed between the first and second oven chambers and in flow communication with the first and second airways. When activated, the fan causes ambient air from the outside of the appliance to pass through the first and second airways before entering the central segment so that the first and second doors are cooled off by the ambient air.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF THE INVENTION

Figure 1:
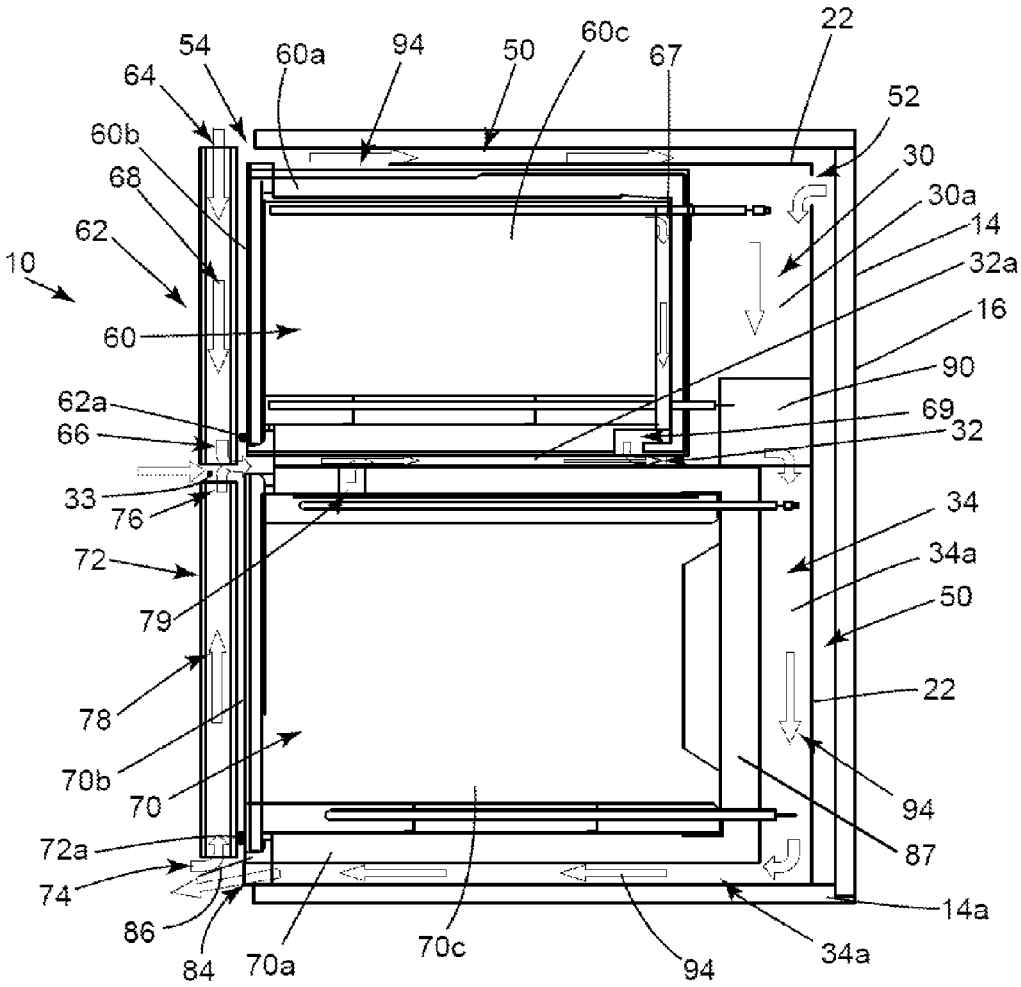
FIG. 1 is a cross sectional side elevational view of an exemplary dual-cavity oven incorporating an embodiment of a vacuum-based reverse airflow cooling system of the present invention installed in a wall.

Referring to FIG. 1, an exemplary appliance such as a dual-cavity oven incorporating a preferred embodiment of a vacuum-based reverse airflow cooling system in accordance with the present invention is generally designated by reference numeral 10. In FIG. 1, the oven 10 is disposed in a recess defined by a wall section 14. The oven 10 sits on the bottom 14*a* of the wall section 14. The oven 10 includes a housing 22 that defines first and second cavities 30, 34 therein. Preferably there is a gap 50 between the top and back of the wall section 14 and the top and back of the housing 22. The gap 50 is in flow or fluid communication with ambient air (i.e., the outside of the dual-cavity oven) through an air inlet 54. The back of the housing 22 has an air inlet 52 through which the first cavity 30 is in flow or fluid communication with the gap 50.

An upper, first oven unit 60 is disposed or positioned in the first cavity 30. The first oven unit 60 includes a first oven chamber 60*a* having a first frontal opening 60*b*. The first oven unit 60 also includes a first oven 60*c* disposed in the first oven chamber 60*a*, and a first oven door 62 for selectively closing the first frontal opening 60*b* of the first oven chamber 60*a*. The first oven chamber 60*a* and the first oven 60*c* preferably form a passageway 67 therebetween. The first oven door 62 can be rotatably attached to the first oven chamber 60*a* or the housing 22 at the hinge point 62*a*. The first oven door 62 has a first, internal airway 68 having an air inlet 64 at its top and an air outlet 66 at its bottom. Preferably the first airway 68 runs the entire length of the first oven door 62 as well as extends across almost the entire width of the first oven door 62. As clearly shown in FIG. 1, there is a gap between the back of the first oven unit 60 and the back of the housing 22. This gap forms a first segment 30*a* of an airflow channel 32 within the housing 22.

Similarly, a lower, second oven unit 70 is positioned in the second cavity 34. The second oven unit 70 includes a second oven chamber 70*a*having a second frontal opening 70*b*. The second oven unit 70 also includes a second oven 70*c*disposed in the second oven chamber 70*a*, and a second oven door 72 for selectively closing the second frontal opening 70*b*of the second oven chamber 70*a*. The second oven chamber 70*a*and the second oven 70*c*preferably form a passageway 87 therebetween. The second oven door 72 can be rotatably attached to the second oven chamber 70*a*or the housing 22 at the hinge point 72*a*. The second oven door 72 has a second, internal airway 78 having an air inlet 74 at its bottom and an air outlet 76 at its top. Preferably the second airway 78 runs the length of the second oven door 72 as well as extends across almost the entire width of the first oven door 72. There is a gap between the back and bottom of the second oven unit 70 and the back and bottom of the housing 22. This gap forms a second segment 34*a*of the airflow channel 32. The second segment 34*a*is in flow or fluid communication with the first segment 30*a*. Additionally, the second segment 34*a*has an air outlet 84 which terminates near the second frontal opening 70*b*so that the second segment 34*a*is in flow or fluid communication with the ambient air. Preferably, a divider 86 is provided, which extends outward and downward from the bottom of the second oven chamber 70*a* so that the air inlet 74 of the second airway 78 is somehow separated from the air outlet 84 of the segment 34*a*.

As shown in FIG. 1, the first and second oven chambers 60*a*, 70*a* are spaced apart from each other so that they form a central segment 32*a* of the airflow channel 32 therebetween. The central segment 32*a* has an air inlet 33 which is disposed adjacent to the air outlets 66, 76 so that the central segment 32*a* is in flow or fluid communication with the first and second airways 68, 78. The central segment 32*a* terminates in the first segment 30*a* so that the central segment 32*a* is in flow or fluid communication with the first segment 30*a*. Moreover, the central segment 32*a* is in flow or fluid communication with the passageway 67 through the opening 69 on the first oven chamber 60*a* and with the passageway 87 through the opening 79 on the second oven chamber 70*a*.

A fan 90 is positioned in the airflow channel 32 for generating positive air pressure in the second cavity 34 and negative air pressure in the first cavity 30. The fan 90 is disposed between the first and second segments 30*a*, 34*a*. More specifically, the fan 90 is disposed in the first segment 30*a* with its intake end facing the first segment 30*a* and its exhaust end facing the second segment 34*a*. The term "fan" used herein covers fans, blowers and other devices suitable for moving air. When energized, the fan 90 generates an airflow path or route as shown by arrows 94 in FIG. 1. More specifically, when energized, the fan 90 draws ambient air from the air inlets 64, 74 and forces the ambient air to flow through the first and second airways 68, 78 before entering the central segment 32*a* so that the first and second oven doors 62, 72 are cooled off by the passing ambient air. The fan 90 also draws ambient air into the first segment 30*a* through the air inlet 52. The ambient air in the central segment 32*a* and the first segment 30*a* then passes through the fan 90, the second segment 34*a* and eventually exits the oven 10 at the air outlet 84. In this configuration, when the fan 90 is energized, the second segment 34*a* has a pressure which is higher than the atmospheric pressure (the pressure outside of the oven 10) while the first segment 30*a* and/or the central segment 32*a* has a pressure which is lower than the atmospheric pressure. Thus, a vacuum-based reverse airflow cooling system for the oven 10 is provided by the present invention, which uses just a single fan 90 to put the first segment 30*a* and/or the central segment 32*a* under negative pressure and the second segment 34*a* under positive pressure. The reverse airflow cooling system actively promotes ambient air flow through the first and second oven doors 62, 72 keeping all surfaces thereof within acceptable temperature limits. Furthermore, the reverse airflow cooling system also provides cooling for at least some of the electrical components of the oven 10. Another advantage of the reverse airflow cooling system is that heat loss from the second chamber 70*a* is reduced by putting the second segment 34*a* under positive pressure. As shown in FIG. 1, the second segment 34*a* surrounds the back and bottom of the second oven chamber 70*a*. Preferably the second segment 34*a* extends across almost the entire width of the back and/or the bottom of the second oven chamber 70*a* so that hot air cannot easily escape from the back and bottom of the second oven chamber 70*a* through the second segment 34*a*.

Another aspect of the invention provides a Human Machine Interface (HMI) integrated into one or both oven doors of the oven 10. The inventive cooling system manifests oven door surface temperatures that are lower than hitherto achievable to an extent where the HMI can be integrated therein. The HMI provides the interface between the consumer and the mechanical, electronic or electromechanical control of the oven. In an embodiment, it includes a consumer interface such as keys or knobs for the consumer to activate and deactivate functions provided by the oven. In another embodiment, the HMI can provide feedback to the consumer, e.g., feedback display or other indicators that inform of the operating status of the oven.

Figure 2:
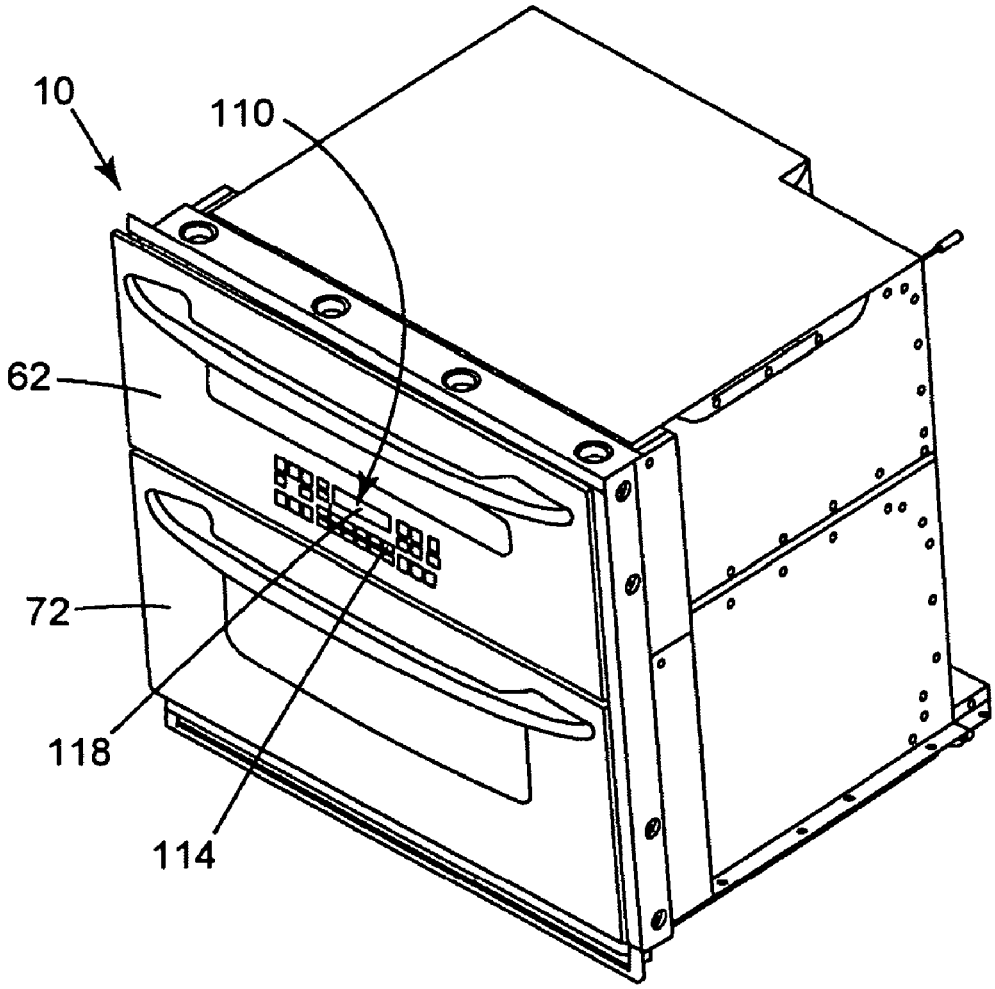
FIG. 2 is a perspective view of the oven of FIG. 1, showing a Human Machine Interface integrated into the upper oven door.

The cooling thereby provided to the first and second oven doors 62, 72 using the inventive reverse airflow cooling system enables the integration of an HMI 110 into, for example, the first oven door 62. The HMI 110 typically includes input and output components for consumer interfacing and feedback via a display module. In FIG. 2, the input components are embodied in the oven 10 as buttons 114. Without limitation, input components for HMI 110 can include keys, knobs, glass touch keys (e.g., glass capacitive touch technology or field-effect switch technology), switches integrated into a membrane that can be adhered to the door, tactile buttons may be integrated into the door, or knobs that can traverse through the door. The output components are embodied in the oven 10 as a display 118. Without limitation, display components for HMI 110 can include displays employing light emitting diodes (LEDs), vacuum fluorescent displays (VFDs), or liquid crystal displays (LCDs). The HMI 110 depicted in FIG. 2 can employ one or more of the elements described herein.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An appliance comprising:

a housing having an airflow channel in flow communication with outside of the appliance;

a first chamber disposed in the housing and having a first opening;

a first door for selectively closing the first opening, the first door having a first airway in flow communication with the outside of the appliance;

a second chamber disposed in the housing and having a second opening;

a second door for selectively closing the second opening, the second door having a second airway in flow communication with the outside of the appliance; and a fan disposed in the airflow channel, wherein the airflow channel comprises a central segment disposed between the first and second chambers and in flow communication with the first and second airways, and wherein when activated, the fan draws ambient air from the outside of the appliance through the first airway and the second airway in a direction toward the central segment and then through the central segment to cool the first door and the second door with the ambient air before the air enters the central segment.

2. The appliance of claim 1, wherein the airflow channel further comprises a first segment disposed between the housing and the first chamber and in flow communication with the central segment, and a second segment disposed between the housing and the second chamber and in flow communication with the first segment and the outside of the appliance, the fan being disposed between the first and second segments so that when the fan is activated, the second segment has a pressure higher than the atmospheric pressure.

3. The appliance of claim 1, further comprising a Human Machine Interface disposed on or in at least one of the first and second doors.

4. The appliance of claim 3, wherein the Human Machine Interface comprises at least one of a consumer interface and a feedback display.

5. An appliance comprising:

a housing having an airflow channel in flow communication with outside of the appliance;

a first oven chamber disposed in the housing and having a first frontal opening;

a first door for selectively closing the first frontal opening, the first door having a first airway in flow communication with the outside of the appliance;

a second oven chamber disposed in the housing and having a second frontal opening;

a second door for selectively closing the second frontal opening, the second door having a second airway in flow communication with the outside of the appliance;

a Human Machine Interface disposed on or in one of the first and second doors; and a fan disposed in the airflow channel, wherein the airflow channel comprises a central segment disposed between the first and second oven chambers and in flow communication with the first and second airways, and wherein when activated, the fan draws ambient air from the outside of the appliance through the first airway and the second airway in a direction toward the central segment and then through the central segment to cool the first door and the second door with the ambient air before the air enters the central segment.

6. The appliance of claim 5, wherein the airflow channel further comprises a first segment disposed between the housing and the first oven chamber and in flow communication with the central segment, and a second segment disposed between the housing and the second oven chamber and in flow communication with the first segment and the outside of the appliance, the fan being disposed between the first and second segments so that when the fan is activated, the second segment has a pressure higher than the atmospheric pressure.

7. The appliance of claim 6, wherein the first segment has a first inlet in flow communication with the outside of the appliance.

8. The appliance of claim 6, wherein when the fan is activated, the first segment has a pressure lower than the atmospheric pressure.

9. The appliance of claim 6, wherein the first oven chamber is disposed above the second chamber and comprises a first back, the first segment adjacent to and extending along the first back.

10. The appliance of claim 9, wherein the second oven chamber comprises a second back and a bottom, the second segment adjacent to and extending along the second back and the bottom.

11. The appliance of claim 5, wherein the Human Machine Interface comprises at least one Of a consumer interface and a feedback display.

12. The appliance of claim 5, wherein the appliance comprises an oven.

13. The appliance of claim 5, wherein the first door is rotatably attached to one of the first oven chamber and the housing.

14. The appliance of claim 5, wherein the second door is rotatably attached to one of the second oven chamber and the housing.

15. The appliance of claim 5, wherein the fan is the only fan disposed in the airflow channel.

* * * * *